United States Patent [19]

Fisher et al.

[11] 3,975,115

[45] Aug. 17, 1976

[54] PUMP CONTROL SYSTEM

[75] Inventors: Lewis M. Fisher, Forestville; Joseph A. Williams, Sebastopol, both of Calif.

[73] Assignee: Hydrodyne Development Company, Forestville, Calif.

[22] Filed: Feb. 7, 1975

[21] Appl. No.: 548,087

[52] U.S. Cl. ..... 417/38; 417/44

[51] Int. Cl.[2] ..... F04B 49/04

[58] Field of Search ..... 417/36, 38, 44

[56] References Cited

UNITED STATES PATENTS

| | | | |
|---|---|---|---|
| 1,987,466 | 1/1935 | Collin | 417/36 |
| 3,393,642 | 7/1968 | Kordik et al. | 417/36 |
| 3,775,026 | 11/1973 | Hewlings | 417/36 |

*Primary Examiner*—William L. Freeh
*Assistant Examiner*—G. P. LaPointe
*Attorney, Agent, or Firm*—Naylor, Neal & Uilkema

[57] ABSTRACT

A pump control system of the liquid level responsive type includes an air pump to pressurize a pressure responsive control unit in accordance with the level of water within a well, the system having an electrical control circuit including a switch which operates to turn off the air motor and turn on the water pump motor when the water level in the well reaches a certain high level and to turn off the pump motor and turn on the air motor when the water level reaches a certain low level in the well.

4 Claims, 3 Drawing Figures

PUMP CONTROL SYSTEM

Among the objects and advantages of the invention are the following: to provide protection against pump damage; to prevent the loss of pump prime; to maintain fairly precise control over liquid levels; and to locate within one compact, above-ground assembly all of the control elements except an air pressure tube which extends into the well.

These and other objects and advantages of the invention will be apparent from the following description taken in conjunction with the drawings forming part of this specification, and in which.

Figures 1, 2:
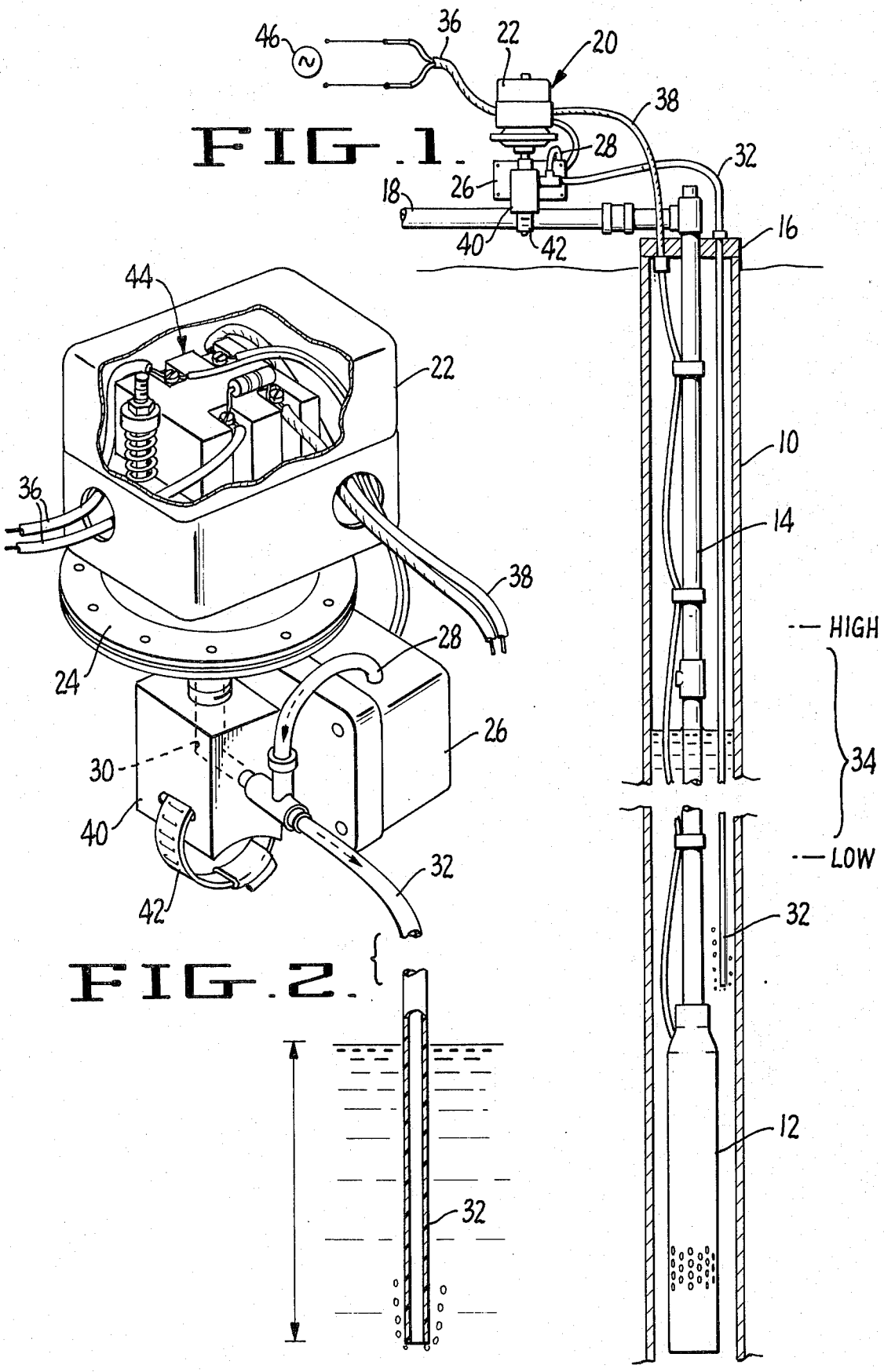
FIG. 1 is a view in side elevation of a water well pumping system with the control system of the invention.
FIG. 2 is an enlarged view in perspective of the control system of the invention.

With reference to the drawings, and particularly to FIG. 1, a well casing 10 is shown as containing a submersible pump 12 connected to water delivery conduit 14 which extends through casing head 16 and connects to a horizontally directed supply line 18. Mounted on the line 18 is a control assemblage or system indicated generally at 20 which comprises a switch housing 22, a diaphragm control unit 24, a housing 26 containing an air pump and motor, an air line 28 which communicates through conduit 30 with the diaphragm unit 24 and through air tube 32 with the water within the casing at a level below the level of the high-low range 34 of operating water levels within the well, power leads 36 and water pump motor supply leads 38. The assemblage comprising units 22, 24 and 26 are interconnected to each other and to a mounting block 40 which in turn is removably clamped to the pipe 18 by strap 42.

Figure 3:
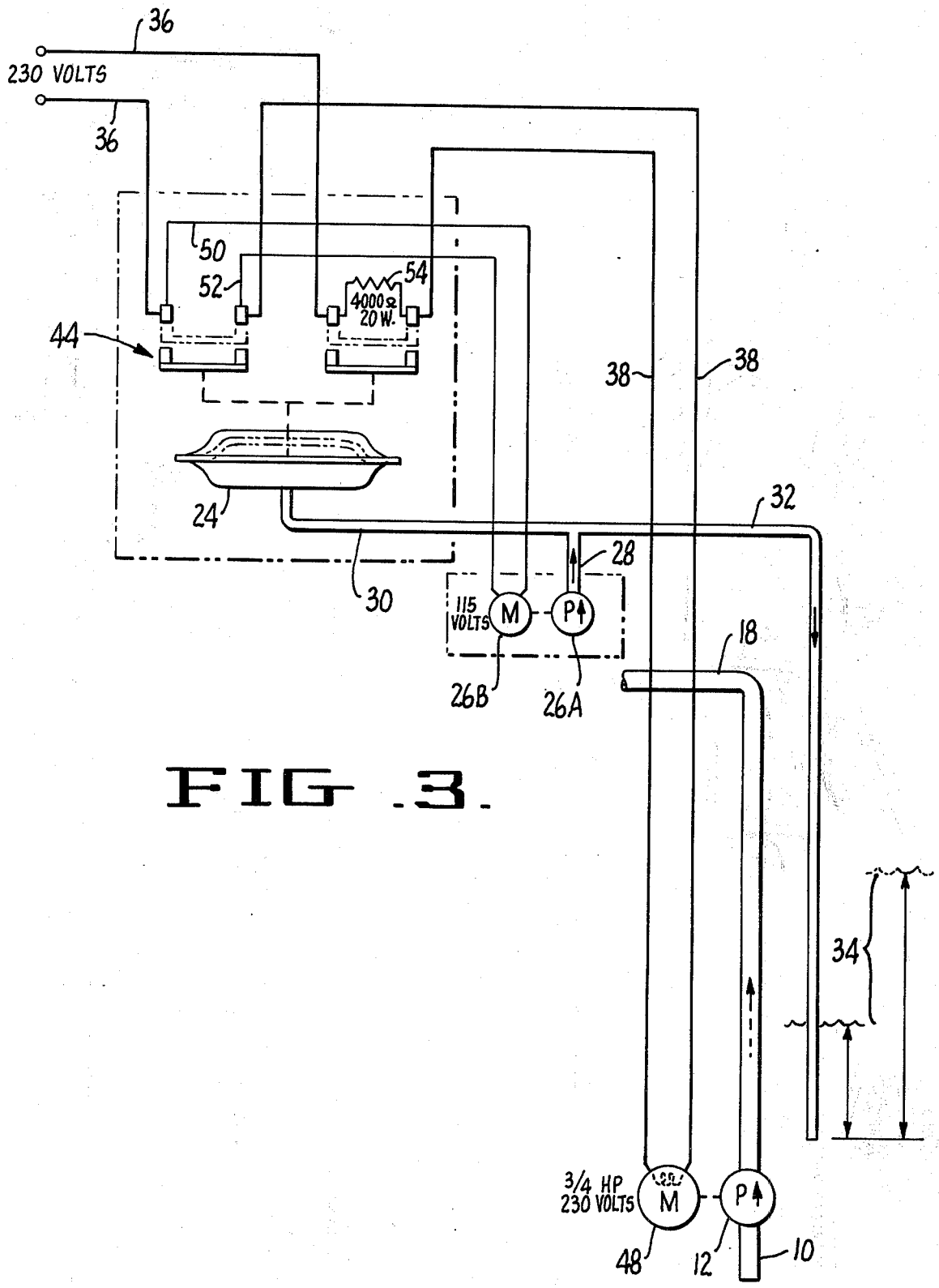
FIG. 3 is a schematic drawing of the pumping system with its superimposed control system which constitutes a fail-safe system as regards the water pump motor.

The enclosed space within casing 10 and head 16 amounts to a closed pressure system, as to which the high and low extremes of the operational range 34 are operationally related to the diaphragm control unit 24, i.e. when the pressure applied to the diaphragm unit by the air system reaches a predetermined high value the air pump is turned off and the water pump is turned on, while when the pressure of the diaphragm unit reaches a predetermined low value the air motor is turned on and the pump motor is turned off. This is economically and efficiently accomplished through the control details of FIG. 3 which will now be described.

Within the housing 22 is a two-pole, normally open switch indicated generally at 44. This switch is activated by the diaphragm unit 24. When the pressure within the air line 30 and the diaphragm unit 24 reaches a predetermined upper value under the action of the air pump or compressor 26A driven by its motor 26B, switch 44 is moved to a closed position to thereby connect the power source 46 to the motor 48 of pump 12. Pump 12 then operates until the water level drops from the high level condition to the low level condition, i.e. through the distance indicated by 34. When this occurs switch 44 is opened and the pump motor 48 is turned off.

When switch 44 opens, the air compressor motor 26B becomes energized via lead 36, lead 50, the windings of motor 26B, lead 52, the windings of pump motor 48, resistor 54 bridging two contacts of one pole of the switch 44, and the other lead 36. The air pump motor 26B is, for example, a 115 volt motor. When the switch 44 is open, the windings of motor 48 act only as a conductor to complete the circuit for the air pump's approximate 4 watt power demand, i.e. 0.3 percent of the power needed to drive a ¾ HP pump motor 48. In the normally open position of switch 44, the air pump motor 26B bridges two contacts of the switch and the resistor 54 bridges two contacts and serves to reduce the voltage. The circuit can thus be completed for a 115 volt flow of 4 watts in a 230 volt circuit. When the switch 44 is closed, full power, e.g. 230 volts is connected to the pump motor 48. The closing of the switch 44 serves to bypass the air pump motor 26B and resistor 54 as far as current flow through these elements is concerned. This is because they have become elements of a high resistance current path and a low resistance path, serving to bypass them, is available, the low resistance path including the pump motor 48.

The control system for the pump 12, i.e. switch 44, diaphragm unit 24 and air pump 26A, constitutes a fail-safe system. That is to say, if the control system should fail it will do so with the switch 44 in the open condition, and the pump will therefore not burn up.

The pump may be of any desired type, such as a submersible pump as depicted, a jet pump or a ground level reciprocating pump.

What is claimed is:

1. For a water well pumping system including a well casing, a water delivery pipe and a water pump having an electric motor; control means to turn the water pump motor on when the level of water within the casing reaches a predetermined high level and to turn the pump motor off when the level reaches a predetermined low level, said control means comprising: an air pump, a low wattage electric motor for the air pump, a two-pole, normally open switch, a voltage source, leads connecting the source with the water pump motor through the switch when the switch is in closed condition, leads connecting the source with the air pump motor through the switch when the switch is in open condition, means including a pressure-responsive diaphragm control unit to open and close the switch, and air tube connections between the well and air pump and between the air pump and diaphragm control unit, whereby when the air pressure within the diaphragm control unit reaches a predetermined upper value the air pump motor is de-energized and the water pump motor is energized upon closure of said switch and when the air pressure within the diaphragm control unit reaches a predetermined lower value the air pump motor is energized and the water pump motor is de-energized upon the opening of said switch.

2. The combination of claim 1 including a first housing for the switch, a second housing for the air pump and air pump motor, means including a mounting block supporting the first and second housings and the diaphragm control unit in interconnected relation, and means for attaching and supporting said mounting block on the water delivery pipe.

3. The combination of claim 1, the switch having connected between two of its contacts at one side of one of its poles a resistor, the effective power supply circuit for the air pump motor when the switch is open comprising said power source, the winding of the air pump motor, the winding of the water pump motor, said resistor, and said power source.

4. For a water well pumping system including a well casing, a water delivery pipe, a water pump having an electric motor, and an air pump having an electric motor; control means to turn the water pump motor on and the air pump motor off when the level of water within the casing reaches a predetermined high level and to turn the water pump motor off and the air pump motor on when the level reaches a predetermined low level, said control means comprising: a normally open switch, a voltage source, circuit means connecting the source with the water pump motor through the switch when the switch is in closed condition, circuit means connecting the source with the air pump motor when the switch is in an open position, means including a pressure-responsive diaphragm control unit to open and close the switch, and an air tube connection between the well and diaphragm control unit, whereby when the air pressure within the diaphragm control unit reaches a predetermined upper value said switch is closed and the water pump motor is energized and the air pump motor is de-energized and when the air pressure within the diaphragm control unit reaches a predetermined lower value said switch is opened and the water pump motor is de-energized and the air pump motor is energized, said control means, save for said air tube, being accessibly disposed above ground level and outside of said casing, said air tube having an open lower end disposed within said casing at a level below said predetermined low level.

* * * * *